US009393679B2

(12) United States Patent
Kim et al.

(10) Patent No.: US 9,393,679 B2
(45) Date of Patent: Jul. 19, 2016

(54) WRENCH SOCKET FOR AUTOMATICALLY MARKING HIGH TENSION BOLT, AND METHOD FOR TIGHTENING HIGH TENSION BOLT USING SAME

(75) Inventors: Kang Seok Kim, Daejeon (KR); Yong Seung Lee, Daejeon (KR); Hwan Seon Nah, Daejeon (KR); Hyeon Ju Lee, Deajeon (KR)

(73) Assignee: KOREA ELECTRIC POWER CORPORATION, Seoul (KR)

( * ) Notice: Subject to any disclaimer, the term of this patent is extended or adjusted under 35 U.S.C. 154(b) by 248 days.

(21) Appl. No.: 14/236,594

(22) PCT Filed: Aug. 2, 2012

(86) PCT No.: PCT/KR2012/006162

§ 371 (c)(1),
(2), (4) Date: Jan. 31, 2014

(87) PCT Pub. No.: WO2013/019081

PCT Pub. Date: Feb. 7, 2013

(65) Prior Publication Data

US 2014/0165795 A1 Jun. 19, 2014

(30) Foreign Application Priority Data

Aug. 2, 2011 (KR) ..... 10-2011-0076835

(51) Int. Cl.
*B25B 23/15* (2006.01)
*B25B 13/06* (2006.01)
(Continued)

(52) U.S. Cl.
CPC ..... *B25B 23/15* (2013.01); *B25B 13/06* (2013.01); *B25B 13/48* (2013.01); *B25B 23/14* (2013.01); *B25B 23/1425* (2013.01)

(58) Field of Classification Search
CPC .... B25B 23/14; B25B 23/15; B25B 23/1425; B25H 7/04
USPC ..... 81/468
See application file for complete search history.

(56) References Cited

U.S. PATENT DOCUMENTS 2,901,934 A * 9/1959 Dunham ..... B25B 23/15 401/195
3,486,402 A * 12/1969 Komsa Sasha ..... B25B 23/15 81/468

(Continued)

FOREIGN PATENT DOCUMENTS

JP 63-133981 A 9/1988
JP 11-104969 A 4/1999

(Continued)

OTHER PUBLICATIONS

International Search Report issued in International Application No. PCT/KR2012/006162 dated Feb. 19, 2013.

*Primary Examiner* — David B Thomas
(74) *Attorney, Agent, or Firm* — McDermott Will & Emery LLP

(57) ABSTRACT

There are provided a wrench socket and a method for tightening a high tension bolt. The wrench socket includes: a first housing making partial contact with a nut; a second housing connected to the first housing and coupled to a handle; a marker disposed in the first and second housings for marking a high tension bolt, the nut, and a washer according to a height of the high tension bolt; a gauge disposed in the first and second housings for making contact with the high tension bolt and reciprocating according to a position of the high tension bolt; and an elastic part configured to apply an elastic force to the gauge according to a position of the gauge unit.

9 Claims, 3 Drawing Sheets

(51) Int. Cl.

| | |
|---|---|
| ***B25B 13/48*** | (2006.01) |
| ***B25B 23/14*** | (2006.01) |
| ***B25B 23/142*** | (2006.01) |

(56) References Cited

U.S. PATENT DOCUMENTS

| | | | | | |
|---|---|---|---|---|---|
| 3,661,040 | A * | 5/1972 | Lesner | B25B 23/15 | 81/468 |
| 3,667,327 | A * | 6/1972 | Lance | B25B 23/15 | 81/468 |
| 3,802,301 | A * | 4/1974 | Peterson | B25B 23/15 | 81/468 |
| 4,462,285 | A * | 7/1984 | Wiltshire | B25B 23/15 | 81/468 |
| 4,768,407 | A * | 9/1988 | Bratt | B25B 23/15 | 251/8 |
| 5,467,674 | A * | 11/1995 | Thorn | B25B 23/15 | 81/467 |
| 5,890,406 | A * | 4/1999 | Thorn | B25B 23/15 | 81/468 |
| 6,112,626 | A * | 9/2000 | Risner | B25B 13/06 | 401/195 |
| 2006/0225519 | A1 | 10/2006 | Nakagawa et al. | | |
| 2014/0208899 | A1 * | 7/2014 | Ito | B25B 23/15 | 81/468 |

FOREIGN PATENT DOCUMENTS

| | | | | |
|---|---|---|---|---|
| JP | 2004284008 | A * | 10/2004 | B25B 23/15 |
| JP | 2006-289535 | A | 10/2006 | |
| JP | 3159541 | U | 5/2010 | |
| JP | 2010155314 | A * | 7/2010 | B25B 23/15 |
| KR | 1998-0036042 | A | 8/1998 | |

* cited by examiner

WRENCH SOCKET FOR AUTOMATICALLY MARKING HIGH TENSION BOLT, AND METHOD FOR TIGHTENING HIGH TENSION BOLT USING SAME

TECHNICAL FIELD

The present disclosure relates to a wrench socket and a tightening method, and more particularly, to a wrench socket for automatically marking a high tension bolt and a method for tightening a high tension bolt using the wrench socket.

BACKGROUND ART

High tension bolts are widely used to couple steel structures in the fields of construction and civil engineering. As methods of tightening high tension bolts, nut rotation methods are widely used in the USA and Europe, and torque management methods are widely used in Korea and Japan. In a torque management method, five or more samples selected from the same type of bolts are tested in the field to determine a target torque, and then the bolts are tightened based on the determined torque. Torque management methods are convenient for field construction as compared to nut rotation methods, but are affected by field conditions such as temperature, humidity, and thread states of nuts and bolts. Practically, if a torque coefficient varies from 0.11 to 0.19 during tightening, an axial force may be only 58 of a target value.

Thereafter, construction specifications state that when nuts and bolts are coupled, nut rotation angles during main tightening should be checked (allowable range: 120°±30°) after primary tightening and marking. However, in construction fields in which several thousands to several tens of thousands of high tension bolts are tightened, it is practically difficult to mark each bolt, and thus checking is rarely carried out in accordance with specifications.

To address such limitations, many techniques of improving clamping axial forces of high tension bolts have been developed at home and abroad. For example, ultrasonic devices for determining bolt axial force, and devices for determining axial force by detecting the power consumption of an electric wrench during tightening have been introduced. There are also many other new techniques. However, such techniques may be uneconomical when applied to the field of construction, and thus, such methods are rarely used for practical applications. In the USA, special washers having protrusions are used. If a target axial force is satisfied, the protrusion of such a washer is plastically deformed to indicate completion of tightening. However, since importation prices of such washers are relatively high, such washers are rarely used in domestic fields. Recently, torque-shearing high tension bolts, which are configured to be fractured at ends thereof at a predetermined torque value to indicate completion of tightening, are widely used in domestic construction fields. However, in the case of torque-shearing high tension bolts, if a pintail thereof is prematurely fractured due to variations in a torque coefficient, a desired amount of axial force may not be obtained, and thus an additional action or management may be necessary.

Although a nut rotation angle is commonly an inspection item after tightening in most tightening methods such as nut rotation methods, torque management methods, and methods of using torque-shearing high tension bolts, marking is rarely carried out after primary tightening in the field, due to the reasons described above, and thus it is practically difficult to inspect nut rotation angles after the completion of tightening.

DISCLOSURE

Technical Problem

Aspects of the present disclosure may include a wrench socket for automatically marking a high tension bolt to check the clamping force of the high tension bolt during tightening, and a method for tightening a high tension bolt using the wrench socket.

Technical Solution

According to an aspect of the present disclosure, a wrench socket may include: a first housing making partial contact with a nut; a second housing connected to the first housing and coupled to a handle to apply force to the nut; a marker disposed in the first and second housings for marking a high tension bolt, the nut, and a washer according to a height of the high tension bolt; a gauge disposed in the first and second housings for making contact with the high tension bolt and reciprocating according to a position of the high tension bolt; and an elastic part configured to apply elastic force to the gauge according to a position of the gauge unit.

The wrench socket may further include a position detector disposed in the second housing to detect the position of the gauge.

The marker may include: an ink storage disposed in the second housing for storing ink and supplying the ink according to the position of the gauge detected by the position detector; and an ink rod through which the ink stored in the ink storage is allow to flow and is dispensed onto the high tension bolt, the nut, and the washer for marking thereof.

If the position of the gauge is detected by the position detector as being varied by a first length, the ink storage may supply ink to the ink rod for a predetermined period of time.

The wrench socket may further include an indicator disposed on the second housing to indicate a clamping force of the high tension bolt by using an image or sound according to the position of the gauge detected by the position detector.

If the position of the gauge is detected by the position detector as being equal to or greater than a second length, the indicator may indicate that the high tension bolt is completely tightened.

The wrench socket may further include a magnetic part disposed on the first housing for attachment to the washer by magnetic force.

The wrench socket may further include an outer case disposed around an outside the first housing and fixed to the second housing.

The wrench socket may further include an input unit disposed on the first housing or the second housing for inputting a type of the high tension bolt therethrough.

According to another aspect of the present disclosure, a method for tightening a high tension bolt may include: primarily tightening a nut on the high tension bolt by placing a first housing around the nut placed around the high tension bolt, rotating the nut by a first angle, and determining whether a position of a gauge making contact with the high tension bolt is varied by a first length; if the position of the gauge is detected by a position detector as being varied by the first length, marking the high tension bolt, the nut, and a washer by using a marker; and performing a mainly tightening procedure, in which the nut is rotated by a second angle using the first housing and if the position of the gauge is detected by the position detector as being varied by a second length, an indicator indicates that the high tension bolt is completely tightened.

Prior to the primarily tightening of the nut on the high tension bolt, the method may further include inputting a type of the high tension bolt through an input unit.

Advantageous Effects

According to embodiments of the present disclosure, a high tension bolt may be marked according to the degree of tightening of the high tension bolt, and the clamping force of the high tension bolt may be indicated through a display unit. Therefore, users may easily tighten high tension bolts and obtain optimal clamping forces of the high tension bolts.

BEST MODE

Figure 1:
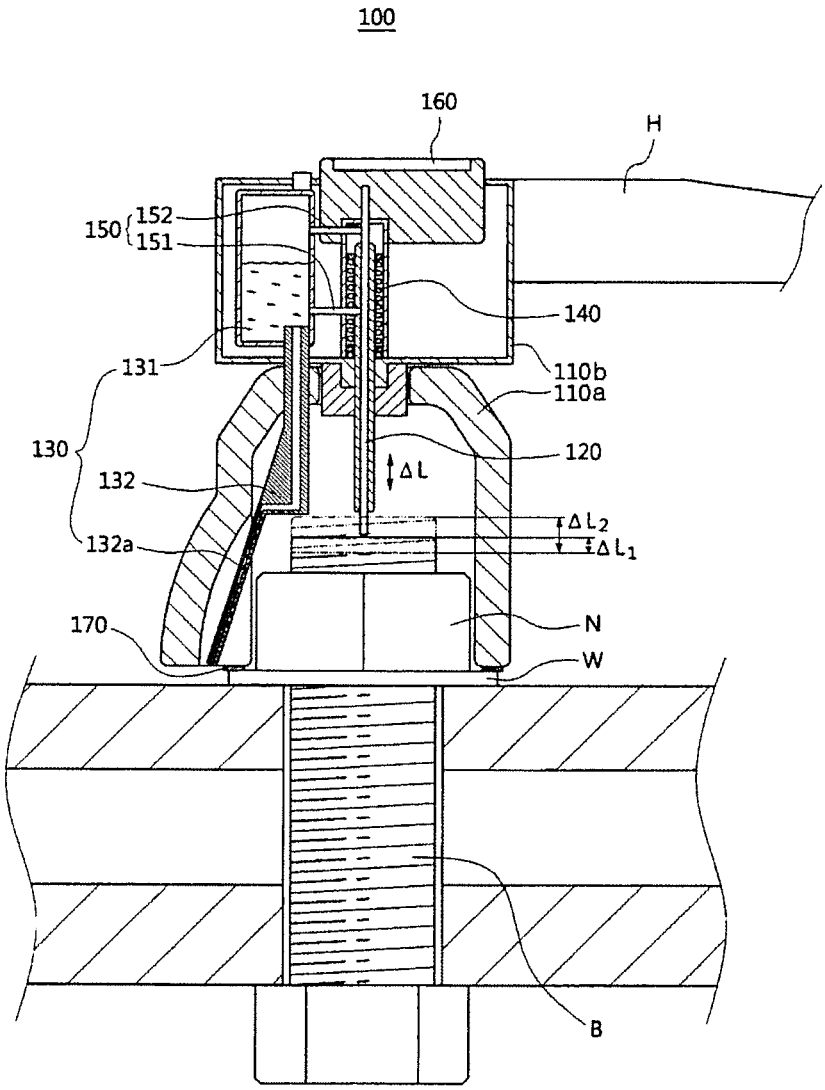
FIG. 1 is a cross-sectional view illustrating a wrench socket according to an embodiment of the present disclosure.

FIG. 1 is a cross-sectional view illustrating a wrench socket 100 according to an embodiment of the present disclosure.

Referring to FIG. 1, the wrench socket 100 includes a first housing 110*a* configured to partially make contact with a nut N and a second housing 110*b* connected to the first housing to apply force to the nut. The second housing 110*b* may be rotatably attached to a handle H. Thus, the first and second housings 110*a* and 110*b* may be rotated by rotating the handle H. For example, the first housing 110*a* may only be rotatable in one direction relative to the handle H.

In detail, if the handle H is rotated in one direction, the first and second housings 110*a* and 110*b* may be rotated together with the handle H. On the contrary, if the handle H is rotated in the opposing direction, the first housing 110*a* may not be rotated together with the handle H but may be stationary on the nut N.

This operational structure is an example. That is, the handle H, the second housing 110*b* and the first housing 110*a* may be moved relative to each other in other manners.

The wrench socket 100 includes a marker 130 disposed in the first and second housings 110*a* and 110*b*. The marker 130 may mark lines on a high tension bolt B, the nut N, and a washer W according to the height of the high tension bolt B. In detail, according to the height of the high tension bolt B, the marker 130 may discharge ink to the outer surfaces of the high tension bolt B, the nut N, and the washer W so as to mark lines thereon.

To this end, the marker 130 may include an ink storage 131 disposed in the second housing 110*b* to store ink. The ink storage 131 may supply ink according to the position of a gauge 120 (to be described later) detected by a position detector 150 (to be described later).

The marker 130 may include an ink rod 132 through which ink stored in the ink storage 131 may flow. Ink may be dispensed through the ink rod 132 onto the high tension bolt B, the nut N, and the washer W. In detail, an ink flow hole 132*a* may be formed in the ink rod 132 to allow ink to pass therethrough.

The wrench socket 100 includes the gauge 120 configured to make contact with the high tension bolt B and reciprocate according to the position of the high tension bolt B. The gauge 120 may be disposed in the first and second housings 110*a* and 110*b*, and the height of the gauge 120 may be varied according to the position of the high tension bolt B.

In addition, the gauge 120 may be disposed in the first and second housings 110*a* and 110*b* and may reciprocate in the first and second housings 110*a* and 110*b*, and an end of the gauge 120 may make point contact with an outer surface of the high tension bolt B.

The wrench socket 100 includes an elastic part 140 configured to apply elastic force to the gauge 120 according to the position of the gauge 120. The elastic part 140 may have various shapes or types. For example, the elastic part 140 may be formed of rubber. The elastic part 140 may be a spring. The following description will be given mainly for the case in which the elastic part 140 is a spring.

The wrench socket 100 may include the position detector 150 disposed in the second housing 110*b* to detect the position of the gauge 120. The position detector 150 may have various shapes or types. For example, the position detector 150 may be a switch turned on or off according to the position of the gauge 120. Alternatively, the position detector 150 may be configured to detect a displacement of the gauge 120 by detecting a variation in a magnetic field according to the height of the gauge 120.

In detail, if the position detector 150 is a switch, the position detector 150 may include a first switch 151 disposed in the second housing 110*b* to determine whether the position of the gauge 120 is varied by a first length. In addition, the position detector 150 may include a second switch 152 disposed in the second housing 110*b* to determine whether the position of the gauge 120 is varied by a second length.

Alternatively, if the position detector 150 is configured to detect a displacement by detecting a variation in a magnetic field, the position detector 150 may include a magnet (not shown) disposed on the gauge 120 to form a magnetic field. In addition, the position detector 150 may include a magnetic field detector (not shown) disposed in the second housing 110*b* to detect a magnetic field formed by the magnet.

However, the position detector 150 is not limited thereto. That is, the position detector 150 may have any structure or type capable of detecting positional variations of the gauge 120. For the purpose of conciseness or clarity, the following description will be given mainly with regard to the case in which the position detector 150 includes the first switch 151 and the second switch 152.

In addition, the wrench socket 100 may include an indicator 160 to indicate the clamping force of the high tension bolt B by using an image or sound according to the position of the gauge 120 detected by the position detector 150. The indicator 160 may be disposed on an outer surface of the second housing 110*b*.

For example, the indicator 160 may include a display unit (not shown) to display an image providing information about the clamping force of the high tension bolt B. In addition, the indicator 160 may include a sound indicator to generate a sound providing information about the clamping force of the high tension bolt B.

For example, if the position of the gauge 120 is detected by the position detector 150 as being varied by a second length or more, the indicator 160 may indicate that the high tension bolt B is completely tightened. That is, since the indicator 160 provides a user with information regarding completion of tightening of the high tension bolt B, the high tension bolt B may provide optimal clamping force.

In addition, the wrench socket 100 may include a magnetic part 170 disposed on the first housing 110*a*. The magnetic part 170 may be fixed to the first housing 110*a* and stick to the washer W by magnetic force.

The wrench socket 100 may include an input unit (not shown) disposed on the first housing or the second housing for inputting the type of the high tension bolt B using the input unit. If the type of the high tension bolt B is input through the input unit, the indicator 160 may indicate a clamping force according to the type of the high tension bolt B. In addition, the size and kind of the high tension bolt B may be determined by selecting the type of the high tension bolt B using the input unit.

Hereinafter, exemplary operations of the wrench socket 100 will be described in detail.

1. Operation for Inputting Type of High Tension Bolt

Before the first housing 110*a* is placed around a nut N, the type of a high tension bolt B may be input through the input unit. Various devices such as a dial input unit or a touch panel may be used as the input unit.

If the type of the high tension bolt B is input through the input unit, the indicator 160 may indicate information necessary for tightening the high tension bolt B, such as the type and clamping force of the high tension bolt B.

In addition, if the type of the high tension bolt B is input through the input unit, an appropriate clamping force may be set according to the type of the high tension bolt B. In detail, a table containing clamping forces according to types of high tension bolt may be previously prepared, and if the type of the high tension bolt B is selected through the input unit, a clamping force corresponding to the high tension bolt B may be automatically set.

The table containing clamping forces according to types of high tension bolts may be stored in a separate storage device (not shown) or a control unit (not shown).

2. Operation 1

After the type of the high tension bolt B is input through the input unit, the nut N may be placed around the high tension bolt B and may be rotated by hand. At this time, if the high tension bolt B is inserted into the nut N to a certain degree, the first housing 110*a* may be placed on the nut N to insert the nut N in the first housing 110*a*.

Then, if force is applied to the handle H, the force may be transmitted to the first and second housings 110*a* and 110*b*. By this, the first and second housings 110*a* and 110*b* may be rotated together with the handle H, and thus the nut N may also be rotated. At this time, the magnetic part 170 may be rotated together with the first housing 110*a* while sliding on and off the washer W.

The nut N may be rotated by the first housing 110*a* by a first angle. As the nut N is rotated, the high tension bolt B may protrude outward from the nut N.

As the high tension bolt B protrudes outwardly from the nut N, the high tension bolt B makes contact with the gauge 120 to vary the position of the gauge 120. Therefore, the gauge 120 may be retracted to an inner side of the first housing 110*a* according to the movement of the nut N.

While the gauge 120 is retracted to the inner side of the first housing 110*a*, if the position variation of the gauge 120 becomes a first length $\Delta L_1$, the gauge 120 may operate the first switch 151. At this time, the elastic part 140 may apply elastic force to the gauge 120. That is, the elastic part 140 may apply resilient force to the gauge 120 in a direction opposite to the moving direction of the gauge 120.

The first length $\Delta L_1$ may be selected according to the type of the high tension bolt B. As described above, the first length $\Delta L_1$ corresponding to the type of the high tension bolt B may be stored in the storage device or the control unit.

The first length $\Delta L_1$ may be determined by calculating a proceeding length of the high tension bolt B per turn of the nut N and calculating a clamping force of the high tension bolt B. In detail, while the high tension bolt B and the nut N are coupled, the proceeding length of the high tension bolt B is equal to an upward displacement $\Delta L$ of an end of the high tension bolt B, and the upward displacement $\Delta L$ may only be determined by the rotation angle of the nut N.

Data relating to the rotation angle of the nut N may be available from a general standard for bolts such as the high tension bolt B (for example, KS B 0201, metric coarse screw threads, Korean Industrial Standards). If the rotation angle of the nut N for each tightening point is calculated based on a relationship between clamping force and the rotation angle of the nut N, the upward displacement $\Delta L$ of the high tension bolt B may be calculated from a relationship between the lead and rotation angle of the nut N. As described above, the upward displacement $\Delta L$ of the high tension bolt B may calculated and stored in the storage device or the control unit.

For example, the upward displacement $\Delta L$ may be calculated as follows. In the case of a general hexagonal bolt (diameter 20 mm, length 140 mm, and pitch 2.5 mm), the first length $\Delta L_1$ may be calculated based on KS B 1010, Korean Industrial Standards. In operation 1, the first length $\Delta L_1$ may be calculated based on the following relationship between clamping force and torque and a relationship between clamping force and nut N rotation angle.

Figure 3A:
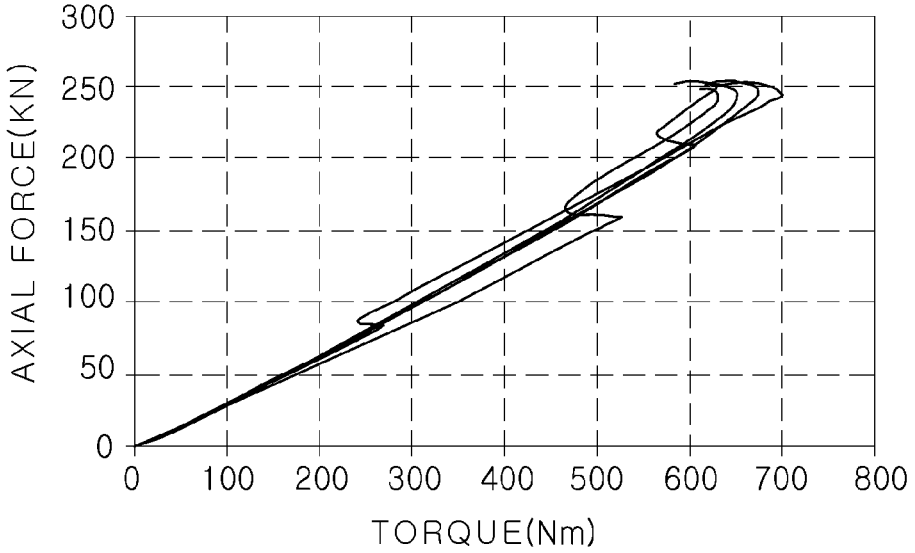
FIG. 3A is a graph showing a relationship between clamping axial force and torque.
Figure 3B:
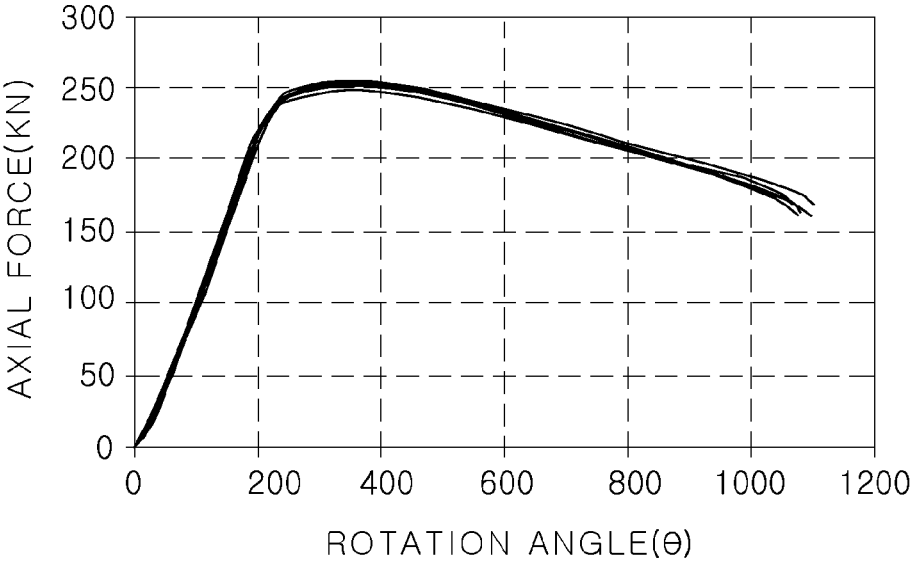
FIG. 3B is a graph showing a relationship between clamping axial force and nut rotation angle.

As shown in FIGS. 3A and 3B, the relationship between clamping force and torque (FIG. 3A) and the relationship between clamping force and nut N rotation angle (FIG. 3B) may be experimentally obtained and stored as a table or other data types in the storage device or the control unit.

In the case of a general hexagonal high tension bolt stated in KS B 1010, Korean Industrial Standards, a reference tightening torque value necessary in operation 1 is 150 Nm (the reference tightening torque value of 150 Nm is a reference design value for 20 mm diameter, F1OT grade, high tension bolts).

The reference tightening torque value may correspond to a clamping force of 45 kN as shown in FIG. 3A. In addition, referring to FIG. 3B, the rotation angle of the nut N corresponding to the clamping force of 45 kN may be 45°.

Since the pitch of the nut N is 20 mm, the first length $\Delta L_1$ corresponding to the rotation angle of 45° may be calculated using a proportional expression. Specifically, the first length $\Delta L_1$ for the rotation angle of 45° and the pitch of 20 mm may be calculated to be 0.35 mm by the expression of 360:45=20:x.

That is, a user may easily calculate and store the first length $\Delta L_1$ using the graphs shown in FIGS. 3A and 3B and a proportional expression, and based on a measured position variation of the high tension bolt B and the stored first length $\Delta L_1$, it may be easily determined whether the nut N is primarily tightened.

As described above, values for the first length $\Delta L_1$ may be stored according to types of high tension bolts in the storage device or the control unit. In this case, if the type of the high tension bolt B is selected through the input unit, a first length $\Delta L_1$ corresponding to the type of the high tension bolt B may be transmitted to the first switch 151 to determine whether the position variation of the gauge 120 is equal to the first length $\Delta L_1$.

3. Operation 2

If the first switch 151 determines that the position variation of the gauge 120 is equal to the first length the first switch 151 may signal the ink storage 131 to discharge ink.

An opening may be formed in the ink storage 131, and an opening/closing device such as a solenoid valve may be disposed in the opening, so as to allow ink from the ink storage 131 to be discharged according to signals transmitted from the first switch 151.

Ink discharged from the ink storage 131 may flow in the ink rod 132. After flowing in the ink rod 132, the ink may be discharged through the ink flow hole 132*a*.

Then, the ink may stick to the high tension bolt B, the nut N, and the washer W for marking lines thereon.

4. Operation 3

After marking as described above, a user may further tighten the nut N on the high tension bolt B by using the handle H. That is, the first and second housings 110*a* and 110*b* may be rotated by rotating the handle H.

As the first and second housings 110*a* and 110*b* are rotated, the nut N is rotated, and then, the end of the high tension bolt B may further protrude outwardly from the nut N. At this time, as described above, the magnetic part 170 may be rotated together with the first housing 110*a*.

By rotating the first and second housings 110*a* and 110*b* in this way, the nut N may be further rotated to mainly tighten the high tension bolt B. In detail, the nut N is rotated by the first housing 110*a* by a second angle, and if the position variation of the gauge 120 reaches a second length $\Delta L_2$, the indicator 160 may indicate that the high tension bolt B is completely tightened.

The second length $\Delta L_2$ may be calculated in a manner similar to that used for calculating the first length $\Delta L_1$. In the main tightening, whether the main tightening is completely may be determined depending on a clamping force between the nut N and the high tension bolt B.

In detail, the second length $\Delta L_2$ may be determined according to a clamping force of the high tension bolt B. For example, the rotation angle of the nut B relative to the high tension bolt B may be determined by referring to the description of operation 2 and FIGS. 3A and 3B.

If the high tension bolt B has the same type as described in operation 2, a target clamping force of the high tension bolt B may be 178 kN. Then, the rotation angle of the nut N corresponding to 178 kN may be 167° as shown in FIG. 3B.

If the rotation angle of the nut N is 167° as described above, the second length $\Delta L_2$ may be calculated to be 1.16 mm. Like the first length $\Delta L_1$, the second length $\Delta L_2$ may be previously set and stored in a table in the storage device or the control unit.

In this case, if the type of the high tension bolt B is input through the input unit, the second length $\Delta L_2$ may be automatically selected.

After the second length $\Delta L_2$ is determined as described above, the second switch 152 may detect whether the position variation of the gauge 120 becomes the second length $\Delta L_2$. In detail, while the position of the gauge 120 is varied according to the rotation of the nut N, the second switch 152 may detect whether the position of the gauge 120 is varied by the second length $\Delta L_2$.

If the second switch 152 detects that the position variation of the gauge 120 is equal to or greater than the second length $\Delta L_2$, the indicator 160 may be operated. That is, the indicator 160 may indicate that the high tension bolt B is completely tightened.

As described above, when a high tension bolt B is primarily tightened using the wrench socket 100, automatic marking is possible based on the upward displacement $\Delta L$ of an end of the high tension bolt B, and thus a user may easily tighten the high tension bolt B using the wrench socket 100.

In addition, since primary tightening and marking are performed at the same time, working hours may be reduced, and quality management may be effectively performed.

After primary tightening, completion of main tightening may be easily checked through the indicator 160, and since whether main tightening is completed is determined by measuring an upward displacement $\Delta L$ relating to a clamping force regardless of surrounding conditions, the clamping force of the high tension bolt B may be constantly managed to improve tightening quality.

Figure 2:
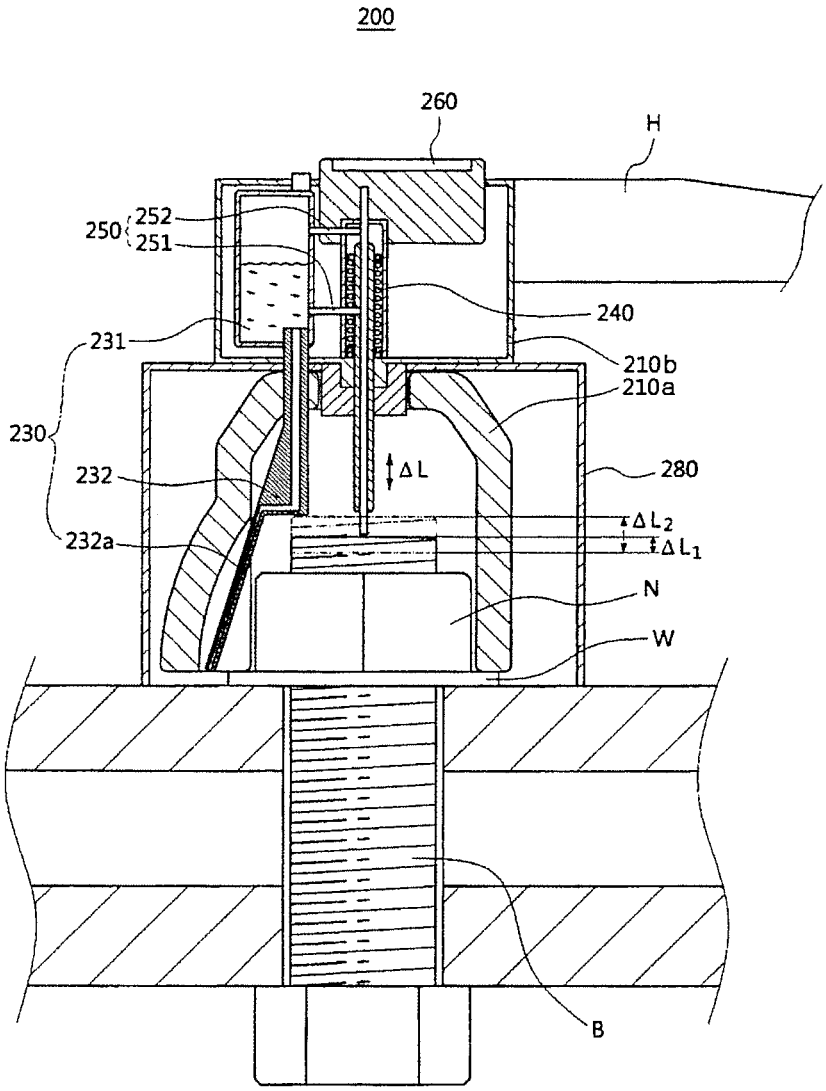
FIG. 2 is a cross-sectional view illustrating a wrench socket according to another embodiment of the present disclosure.

FIG. 2 is a cross-sectional view illustrating a wrench socket 200 according to another embodiment of the present disclosure.

Referring to FIG. 2, the wrench socket 200 may include a first housing 210*a*, a second housing 210*b*, a marker 230, a gauge 220, an elastic part 240, a position detector 250, and an indicator 260. The marker 230 may include an ink storage 231 and an ink rod 232. The first housing 210*a*, the second housing 210*b*, the marker 230, the gauge 220, the elastic part 240, the position detector 250, the indicator 260, the ink storage 231, and the ink rod 232 are similar to those described with reference to FIG. 1, and thus descriptions thereof will not be repeated.

The wrench socket 200 may include an outer case 280 disposed around the first housing 210*a*. The outer case 280 may be attached to the second housing 210*b*. When force is applied to the handle H, the outer case 280 may prevent the first housing 210*a* from being separated from a nut N.

The wrench socket 200 is operated in a similar manner to that described with reference to FIG. 1, and thus the operation of the wrench socket 200 will not be described in detail.

When a high tension bolt B is primarily tightened using the wrench socket 200, marking may be automatically carried out based on whether an upward displacement $\Delta L$ of an end of the high tension bolt B becomes a first length $\Delta L_1$. Therefore, a user may easily tighten the high tension bolt B using the wrench socket 200.

In addition, since primary tightening and marking are performed at the same time using the wrench socket 200, working hours may be reduced, and quality management may be effectively performed.

After primary tightening, completion of main tightening may be easily checked through the indicator 260, and since whether main tightening is completed is determined by measuring an upward displacement $\Delta L$ relating to a clamping force regardless of surrounding conditions, the clamping force of the high tension bolt B may be constantly managed to improve clamping quality.

Particularly, when a high tension bolt B and a nut N are coupled by using the wrench socket 200, the outer case 280 may prevent separation of the first housing 210*a*, and thus the high tension bolt B and the nut B may be stably coupled.

While exemplary embodiments have been shown and described above, it will be apparent to those skilled in the art that modifications and variations could be made without departing from the spirit and scope of the present disclosure as defined by the appended claims.

The invention claimed is:

1. A wrench socket comprising:

a first housing making partial contact with a nut;

a second housing connected to the first housing and coupled to a handle to apply force to the nut;

a marker disposed in the first and second housings for marking a high tension bolt, the nut, and a washer according to a height of the high tension bolt;

a gauge disposed in the first and second housings for making contact with the high tension bolt and reciprocating according to a position of the high tension bolt;

an elastic part configured to apply elastic force to the gauge according to a position of the gauge; and a position detector disposed in the second housing to detect the position of the gauge, wherein if the position of the gauge is detected by the position detector as being varied by a first length, the marker marks the high tension bolt, the nut, and the washer.

2. The wrench socket of claim 1, wherein the marker comprises:

an ink storage disposed in the second housing for storing ink and supplying the ink according to the position of the gauge detected by the position detector; and an ink rod through which the ink stored in the ink storage is allow to flow and is dispensed onto the high tension bolt, the nut, and the washer for marking thereof.

3. The wrench socket of claim 1, further comprising an indicator disposed on the second housing to indicate a clamping force of the high tension bolt by using an image or sound according to the position of the gauge detected by the position detector.

4. The wrench socket of claim 3, wherein if the position of the gauge is detected by the position detector as being equal to or greater than a second length, the indicator indicates that the high tension bolt is completely tightened.

5. The wrench socket of claim 1, further comprising a magnetic part disposed on the first housing for attachment to the washer by magnetic force.

6. The wrench socket of claim 1, wherein the wrench socket automatically marks a high tension bolt and further comprises an outer case disposed around an outside the first housing and fixed to the handle second housing.

7. The wrench socket of claim 1, wherein the wrench socket automatically marks a high tension bolt and further comprises an input unit disposed on the first housing or the second housing for inputting a type of the high tension bolt therethrough.

8. A method for tightening a high tension bolt, the method comprising:

primarily tightening a nut on the high tension bolt by placing a first housing around the nut placed around the high tension bolt, rotating the nut by a first angle, and determining whether a position of a gauge making contact with the high tension bolt is varied by a first length;

if the position of the gauge is detected by a position detector as being varied by the first length, marking the high tension bolt, the nut, and a washer by using a marker; and performing a mainly tightening procedure, in which the nut is rotated by a second angle using the first housing and if the position of the gauge is detected by the position detector as being varied by a second length, an indicator indicates that the high tension bolt is completely tightened.

9. The method of claim 8, wherein prior to the primarily tightening of the nut on the high tension bolt, the method further comprises inputting a type of the high tension bolt through an input unit.

* * * * *